US006806432B1

(12) United States Patent
Ryan et al.

(10) Patent No.: US 6,806,432 B1
(45) Date of Patent: Oct. 19, 2004

(54) SUPERCONDUCTING COILS

(75) Inventors: David Thomas Ryan, Oxford (GB); Martin Norman Wilson, Abingdon (GB)

(73) Assignee: Oxford Instruments Superconductivity Limited, Oxon (GB)

( * ) Notice: Subject to any disclaimer, the term of this patent is extended or adjusted under 35 U.S.C. 154(b) by 0 days.

(21) Appl. No.: 09/979,125

(22) PCT Filed: May 18, 2000

(86) PCT No.: PCT/GB00/01909

§ 371 (c)(1),
(2), (4) Date: Feb. 19, 2002

(87) PCT Pub. No.: WO00/72335

PCT Pub. Date: Nov. 30, 2000

(30) Foreign Application Priority Data

May 19, 1999 (GB) ..... 9911680

(51) Int. Cl.[7] ..... H01F 6/00

(52) U.S. Cl. ..... 219/50; 505/430

(58) Field of Search ..... 219/50, 155; 505/430, 505/433

(56) References Cited

U.S. PATENT DOCUMENTS

| | | | | |
|---|---|---|---|---|
| 4,239,077 A | | 12/1980 | Dixon et al. | |
| 5,721,414 A | * | 2/1998 | Lacourcelle | 219/50 |
| 5,758,405 A | | 6/1998 | Bent et al. | |
| 5,798,678 A | | 8/1998 | Manlief et al. | |

FOREIGN PATENT DOCUMENTS

| | | |
|---|---|---|
| DE | 3030184 | 3/1982 |
| FR | 2365866 | 4/1978 |

* cited by examiner

*Primary Examiner*—Clifford C. Shaw

(57) ABSTRACT

A method of heat treating a coil (14) for use as a superconducting coil. The coil (14) is heated in a furnace, the temperature of the furnace being controlled to perform a predetermined heating cycle. A current is passed through the coil (14) for at least a portion of the heating cycle so as to further heat the coil by resistance heating.

17 Claims, 3 Drawing Sheets

SUPERCONDUCTING COILS

The present invention relates to the heat treatment of a coil for use as a superconducting coil, and in particular coils which are manufactured by a "wind and react" process, for use in a superconducting magnet The present invention further relates to a coil for use as a superconducting coil which is suitable for undergoing such a heat treatment process.

The "wind and react" process is a technique which is frequently used with superconducting materials which, in their fully reacted state, are so brittle that winding them into a coil would cause fracture. To avoid problems of this kind, the coils are first wound from the superconducting wire or coil material in an unreacted state, where the material is ductile. A reaction heat treatment is then applied to bring about the desired reactions in the superconducting material.

A commonly observed problem in "wind and react" coils made from materials such as Bismuth Strontium Calcium Copper Oxide (B2212), is that the critical current of the superconducting coil material is substantially less in the coil than it would be if the same coil material was heat treated in the form of a short sample. This is caused by problems relating to the diffusion of heat, and the diffusion of oxygen, through the volume of the coil.

The problems associated with the diffusion of heat through the coil will now be outlined. FIG. 1 shows a typical reaction heat treatment cycle for the melt processing of B2212. This processing is carried out in an atmosphere of pure oxygen or an oxygen nitrogen mixture. During a first stage 1 of the process, the temperature is ramped up over a period of several hours to a level which is just sufficient to melt the B2212. As shown in more detail in FIG. 2, during a second stage 2, the temperature is maintained substantially at the melt temperature for a few minutes, before the temperature is ramped down during a third stage 3 by approximately 30° C. A fourth stage 4 is a very slow ramp down which serves to anneal the material, after which the temperature is reduced rapidly to ambient during a fifth stage 5.

For optimum superconducting properties it is essential for this heat treatment to be tightly controlled. In particular, the peak melting temperature of approximately 885° C. must be held to a precision of 1° C. Furthermore, it is important for the melt time to be controlled at a precise time of a few minutes.

These conditions can readily be obtained for short samples of conductor in a furnace with a precisely controlled temperature profile. In coils however the temperature within the winding is not uniform because heat takes a finite time to diffuse from the outside of the coil to the inside.

FIG. 2 shows measurements of the temperature inside and outside a small experimental coil, during the first, second and third stages 1,2,3 of the melt sequence. It may be seen that the temperature inside the coil lags behind the temperature outside the coil such that the peak temperature is 2–3° C. less. The time at peak temperature is also substantially less for the inner region than for the outer region. It follows that if the furnace profile is set to give the optimum heat treatment to the outer regions of the coil, the inner regions will be sub-optimal, and vice versa.

These results were obtained for a small coil of only a few mm thickness. It is a well known result of diffusion theory that thermal diffusion times scale as the square of the smallest dimension. Thus for a coil of 3×the thickness, the thermal diffusion time would be 9 times as long and the difference between inner and outer temperatures would be more than 20° C.

In accordance with a first aspect of the present invention, we provide a method of heat treating a coil for use as a superconducting coil, the method comprising the steps of:

heating the coil in a furnace, the temperature of the furnace being controlled to perform a predetermined heating cycle; and, passing a current through the coil for at least a portion of the heating cycle so as to further heat the coil by resistance heating.

The first aspect of the invention therefore provides a method of offsetting the problems of heat transfer through the coil by means of an electrical heating boost. With all the turns in the coil insulated from each other, the electric boost may be achieved by simply passing a current through the coil material.

Typically the predetermined heating cycle comprises:

a first heating portion in which the temperature of the coil is increased to a first predetermined temperature;

a second portion in which the temperature of the coil is maintained at the first predetermined temperature;

a third cooling portion in which the temperature of the coil is deceased to a second predetermined temperature;

a fourth cooling portion in which the temperature of the coil is deceased to a third predetermined temperature; and, a fifth cooling portion in which the coil is unheated and allowed to cool.

However, it will be realized that other suitable heating cycles may be used depending on the type of coil material, the coil configuration and other factors.

When the abovementioned heating cycle is used, the method typically comprises passing the current through the coil during at least the first heating portion of the heating cycle. This ensures that the effects of poor heat transfer through the coil are minimized as the maximum temperature is reached.

Preferably the method further comprises controlling the current to maintain the inner surface of the coil at substantially the same temperature as the outer surface of the coil.

In this case, this may be achieved by controlling the current in accordance with the equation:

$$\gamma C\frac{d\theta}{dt} = J^2\rho$$

where: γ=mean density of the coil material

C=mean specific heat of the coil material $$\frac{d\theta}{dt} = \text{required rate of change of temperature}$$

J=mean current density in the coil material

ρ=mean resistivity of the coil material

Typically the predetermined heating cycle is performed in an atmosphere of pure oxygen or an oxygen/nitrogen mixture.

As far as the problems relating to oxygen diffusion are concerned, during the heat treatment cycle shown in FIG. 1, chemical changes occur in the superconducting material which cause oxygen to be evolved or absorbed. Accordingly, variations in the concentration of oxygen throughout the coil can cause variations in the effectiveness of the heat treatment.

A further effect results from the fact that the melting point of B2212 is reduced if the partial pressure of oxygen is reduced. Accordingly, for a tightly wound coil, there is thus a danger that during those times when oxygen is being absorbed, the partial pressure of oxygen in the innermost regions of the coil will be reduced. This reduction will lower the melting point of the B2212, which will produce two undesirable effects:

a) the maximum temperature will not be optimal for the best superconducting properties; and, b) the B2212 will be more fully melted and will therefore be more likely to leak out of its silver sheath and cause shorted turns in the coil (a well known problem of melt processed coils).

In accordance with a second aspect of the present invention, we provide a coil for use as a superconducting coil, the coil being suitable for undergoing a heat treatment process in an oxidizing atmosphere, the coil comprising layers of insulating material interspersed between layers of the coil, the insulating material comprising a fibre mat arranged so as to allow diffusion of the oxidizing atmosphere throughout the coil.

The second aspect of the invention overcomes the problems associated with poor oxygen diffusion through the coil by constructing the coil to allow a free circulation of oxygen through the windings during the heat treatment. This circulation is achieved by making the insulation between each layer of the coil porous, so that oxygen may easily diffuse from the ends of the coil into the center.

Typically the fibre mat comprises a tissue paper layer with a number of spaced substantially parallel fibres glued thereon. The use of the parallel spaced fibers results in the formation of channels between the coil layers which helps enhance the flow of oxygen through the coil.

Preferably the coil is configured such that the fibres of the fibre mats are substantially aligned with the axis of the coil. This not only provides the abovementioned channels but also ensures the channels terminate at the ends of the coil. This allows the oxygen to flow into the ends of the channels so as to penetrate the coil, whilst ensuring that adjacent layers of the coil do not touch.

Typically the fibers are formed from a ceramic or a refractory oxide. Examples of suitable materials include aluminium or zirconium oxide, which are manufactured in the form of fibers, such as Nextel ®. However, any material that can withstand the high temperatures in an oxidizing atmosphere, may be used, although these must not react chemically with the coil material during reaction.

In accordance with a third aspect of the present invention, we provide a method of constructing a fibre mat for use in the above described coil, the method comprising:

forming a tube of tissue paper around a former;

fixing a single layer helix of fibre to the tissue paper tube; and, cutting the tissue paper tube parallel to the tube axis to form the fibre mat.

This construction allows a fibre mat suitable for use in a superconducting coil to be easily and cheaply produced.

Typically the fibre is glued to the tissue paper, although other forms of fixing may be used.

It will be realized that the coil according to the second aspect of the invention may readily be heat treated using the method of the first aspect of the invention.

In this case, the predetermined heating cycle causes the tissue paper to burn away, which advantageously leaves the fibre to insulate the layers of the superconductor coil.

Typically, if the paper is to be burnt away, the first heating portion is modified to include a time period during which the temperature is maintained substantially constant to thereby ensure complete removal of the paper.

As will be appreciated, the invention makes improvements to the insulation technique and the heat treatment process which produce substantial improvements in the performance of resulting superconducting coils. Whilst it is primarily intended for use with superconducting coil materials made by the "powder in tube" process from silver and the high temperature superconducting material Bismuth Strontium Calcium Copper oxide B2212, it could also be used with other superconducting materials requiring a reaction heat treatment.

Examples of the present invention will now be described with reference to the accompanying drawings, in which:

Figure 1:
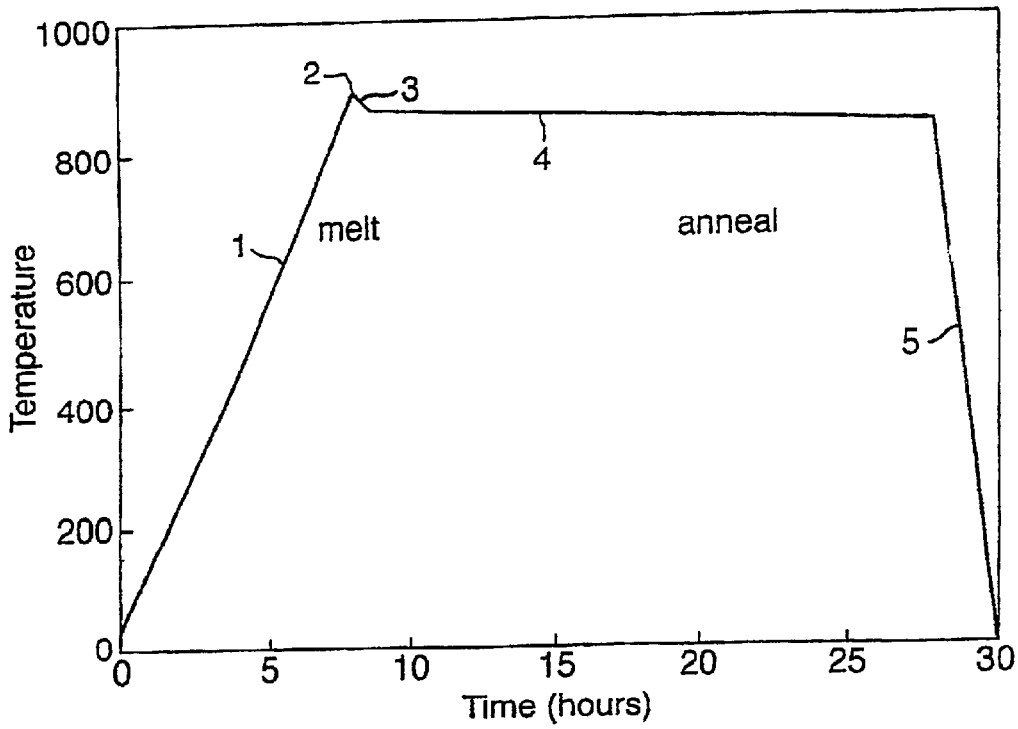
FIG. 1 is a graph of a typical reaction heat treatment cycle for the melt processing of B2212.
Figure 2:
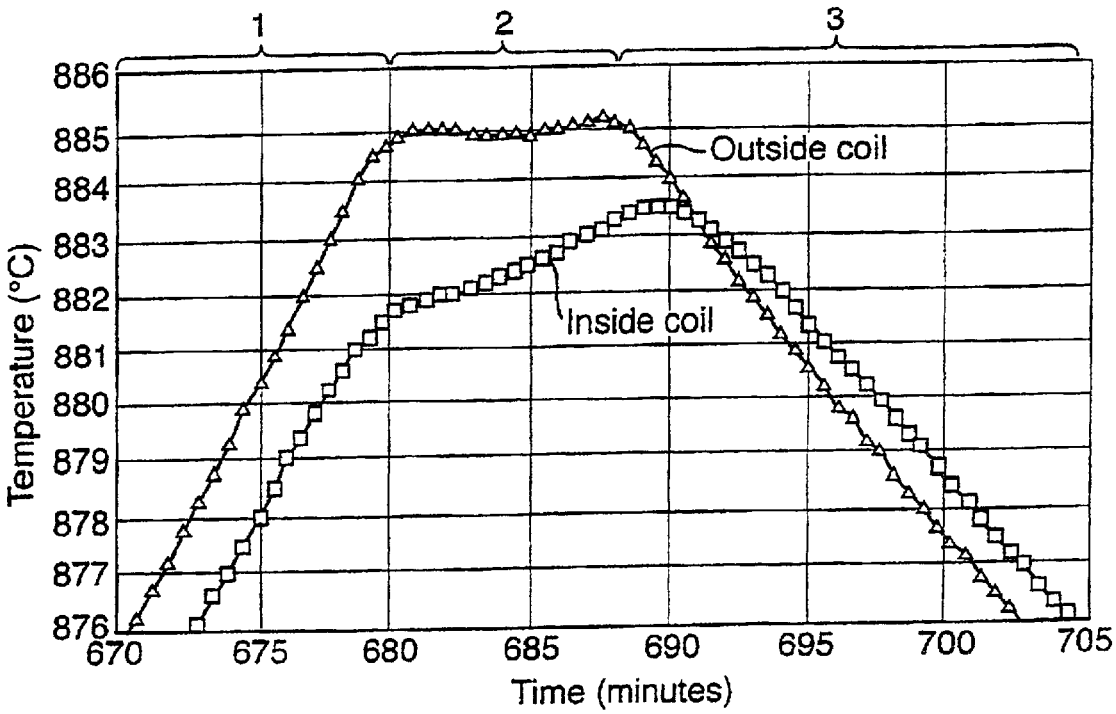
FIG. 2 is a graph of typical measurements of temperature inside and outside a small experimental coil during the melt sequence of FIG. 1.

In the example of the first aspect of the invention, the heat treatment of the superconductor coil is substantially the same as in the prior art described with respect to FIGS. 1 and 2 above. However, in contrast to the prior art, a current is supplied to the coil during the heat treatment process.

In this case the heating cycle of the furnace is controlled to maintain the outer regions of the coil at the idealized temperatures. With the coil material transferring current in the resistive (quenched) state, the current flow through the coil generates heat which is used to ensure that the inner region of the coil also maintains the desired temperature profile throughout the heating cycle.

This is achieved by controlling the current to maintain a zero temperature difference between the inside and outside regions of the coil. Provided the heating current is controlled to maintain zero temperature gradients in the coil, there will be no heat transfer between the furnace and the interior of the coil.

The resistive heating power required can be determined from the required rate of change of temperature and the specific heat of the coil material, and is given by the equation below:

$$\gamma C\frac{d\theta}{dt} = J^2\rho$$

where: $\gamma$=mean density of the coil material

C=mean specific heat of the coil material $$\frac{d\theta}{dt} = \text{required rate of change of temperature}$$

J=mean current density in the coil material

ρ=mean resistivity of the coil material

For a typically required temperature ramp rate of approximately 60° C./hour, using the properties of silver and B2212 at approximately 890° C., we find a required current density of:

$$J=0.7\ A.mm^{-2}$$

For a coil formed from a coil material having a cross-section of 0.2 mm×3.0 mm, this is equivalent to a current of 0.42 Amps.

As mentioned above, the furnace is controlled such that the outer surface of the coil follows the desired temperature profile. The additional heating effect provided by the current is only used to ensure that the inner region of the coil also follows the same temperature profile and accordingly, it is possible to simply apply the current indicated by the above equation.

However, an alternative is to apply the current specified by the equation and monitor either an inner or an outer region of the coil. If the monitored portion of the coil deviates from the ideal temperature profile, then as the furnace is temperature controlled then the deviation is caused by the resistance heating. Accordingly, the current can be controlled by a feedback system such that if the temperature of the coil exceeds the desired temperature then the current and hence the amount of resistance heating is reduced. Similarly, if the coil is too cool then the current and hence the effect of the resistance heating is increased.

A further alternative is to measure the temperature of both the inner and outer regions of the coil. The heating effect caused by the resistance heating is used to ensure that the inner region of the coil follows the temperature profile of the outer region of the coil. Accordingly, if the inner region of the coil becomes cooler than the outer region then the current flow is increased to increase the heating effect. Similarly, if the inner region of the coil is hotter than the outer region then the current flow and hence the resistance heating effect is reduced.

As will be appreciated by a person skilled in the art, the temperatures of the coil regions can be measured using an appropriately positioned thermocouple.

The current is only applied during the first stage 1 of the heat treatment process when the temperature is ramped up to the level which is just sufficient to melt the B2212. Once the plateau at the beginning of the second stage 2 is reached, the heating current is switched off allowing the coil to equalize temperature with ambient temperature in the furnace. Once the second stage 2 is complete, the coil is then allowed to cool in the normal way.

Figure 3:
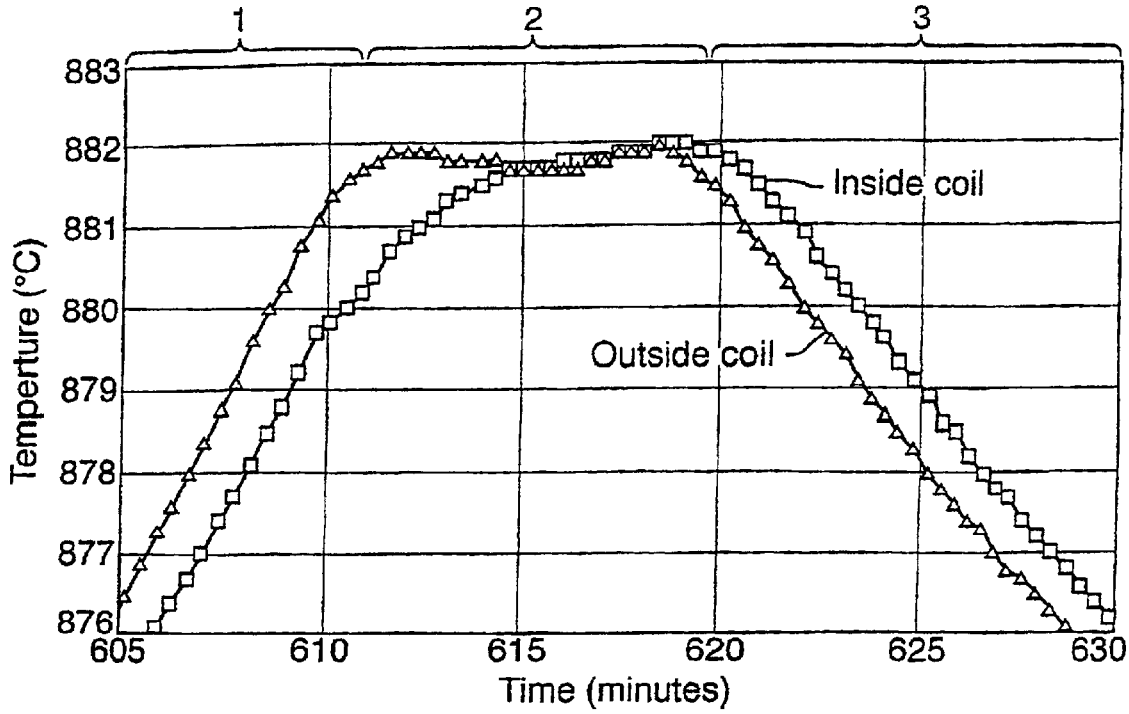
FIG. 3 is a graph of typical measurements of temperature inside and outside a small experimental coil being heat treated in accordance with the first aspect of the present invention.

The results of operating the current heating during the first heating period are illustrated in FIG. 3. This shows that the temperature difference between the inner and outer regions of the coil is vastly reduced when compared to the results obtained by the prior art method, shown in FIG. 2.

In the example of the second aspect of the invention, the coil is itself modified by providing porous insulating layers between the layers of the coil material.

Figure 4A:
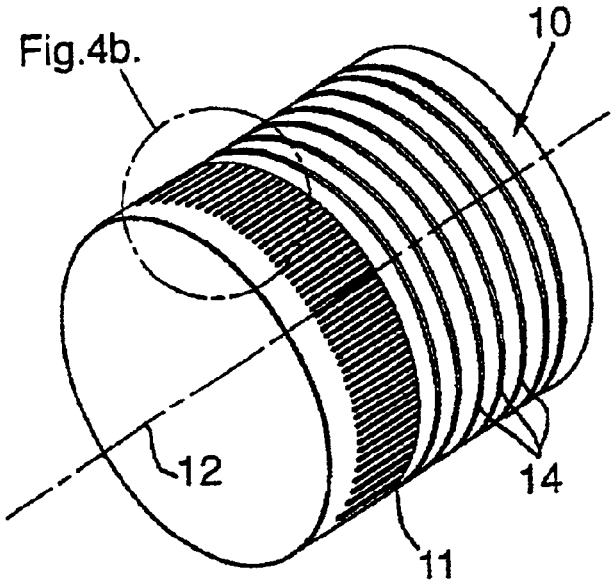
FIG. 4*a* is a cut-away perspective view of a superconducting coil formed in accordance with the second aspect of the present invention.
Figure 4B:
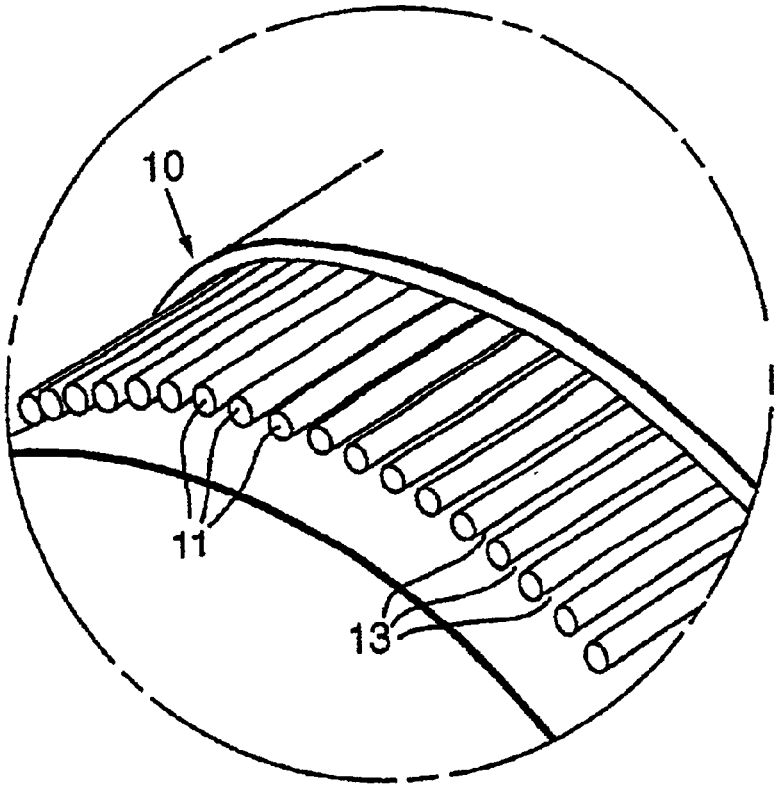
FIG. 4*b* is an enlarged view of a portion of FIG. 4*a*.

In this example, the porous insulating layers are in the form of fibre mats which are laid between each layer of the coil. As shown in FIGS. 4*a* and 4*b*, the fibre mat 10 is laid over a layer of the coil (not shown) with ceramic fibers 11 aligned parallel to the coil axis 12. Spaces 13 between the ceramic fibers 11 ensure that there is a free passage of oxygen between the layers of the coil material. Oxygen may thus diffuse from each end of the coil into all the innermost regions. Once the fibre mat 10 is in positions the next layer 14 of the coil is added.

Figure 5:
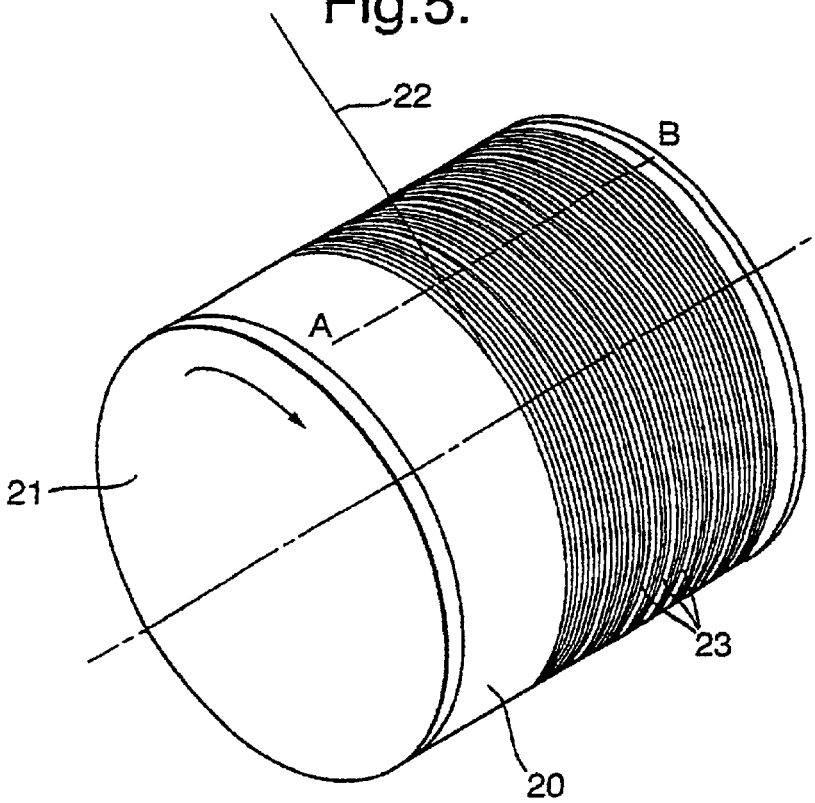
FIG. 5 is a perspective view showing the formation of a fibre mat in accordance with the third aspect of the present invention.

The fibre mats 10 may be produced as shown in FIG. 5. Firstly, a layer of very thin tissue paper 20 is wrapped around a smooth cylindrical metallic mandrel 21. Next a single layer helix of ceramic fibre 22 is wound onto the tissue paper 20, leaving some spaces 23 between adjacent turns, as shown in FIG. 5. The fibers are fixed to the tissue paper with a thin layer of glue. Finally, a cut is made in the paper 20 and fiber 22, along the line AB in FIG. 5, so that the paper may be removed from the mandrel and laid flat.

This fibre mat 10 may then be used as an interleaving sheet between each layer of the coil, as shown for example in FIGS. 4*a* and 4*b*. During the heat treatment, the tissue paper will burn away completely.

For preference, a plateau of several hours at a temperature of between 700° C. and 800° C. can be provided during the first stage 1 of the heating cycle, to ensure complete removal of any carbon from the tissue.

What is claimed is:

1. A method of heat treating a coil for use as a superconducting coil, the method comprising:

heating the coil in a furnace, the temperature of the furnace being controlled to perform a predetermined heating cycle; and, passing a current through the coil for at least a portion of the heating cycle so as to further heat the coil by resistance heating.

2. A method according to claim 1, wherein the predetermined heating cycle comprises:

a first heating portion in which the temperature of the coil is increased to a first predetermined temperature;

a second portion in which the temperature of the coil is maintained at the first predetermined temperature;

a third cooling portion in which the temperature of the coil is deceased to a second predetermined temperature;

a fourth cooling portion in which the temperature of the coil is deceased to a third predetermined temperature; and, a fifth cooling portion in which the coil is unheated and allowed to cool.

3. A method according to claim 2, the method further comprising passing the current through the coil during at least the first heating portion of the heating cycle.

4. A method according to claim 2, wherein the coil comprises layers of insulating material interspersed between layers of the coil, the insulating material comprising a fibre mat arranged so as to allow diffusion of the oxidizing atmosphere throughout the coil.

5. A method according to claim 4, the fibre mat comprising a tissue paper layer with a number of spaced substantially parallel fibers glued thereon.

6. A method according to claim 5, wherein the predetermined heating cycle causes the tissue paper to bum away.

7. A method according to claim 6, the first heating portion being modified to include a time period during which the temperature is maintained substantially constant to thereby ensure complete removal of the paper.

8. A method according to claim 4, the fibers being formed from a ceramic or a refractory oxide.

9. A method according to claim 4, the coil being configured such that the fibers of the fibre mats are substantially aligned with the axis of the coil.

10. A method according to claim 1, the method further comprising controlling the current to maintain the inner surface of the coil at substantially the same temperature as the outer surface of the coil.

11. A method according to claim 10, the method comprising controlling the current in accordance with the equation:

$$\gamma C\frac{d\theta}{dt} = J^2\rho$$

where: γ=mean density of the coil material

C=mean specific heat of the coil material $$\frac{d\theta}{dt} = \text{required rate of change of temperature}$$

J=mean current density in the coil material

ρ=mean resistivity of the coil material.

12. A method according to claim 1, the method further comprising performing the predetermined heating cycle in an atmosphere of pure oxygen or an oxygen/nitrogen mixture.

13. A method according to claim 1, wherein the coil comprises layers of insulating material interspersed between layers of the coil, the insulating material comprising a fibre mat arranged so as to allow diffusion of the oxidizing atmosphere throughout the coil.

14. A method according to claim 13, the fibre mat comprising a tissue paper layer with a number of spaced substantially parallel fibers glued thereon.

15. A method according to claim 14, wherein the predetermined heating cycle causes the tissue paper to burn away.

16. A method according to claim 13, the fibers being formed from a ceramic or a refractory oxide.

17. A method according to claim 13, the coil being configured such that the fibers of the fibre mats are substantially aligned with the axis of the coil.

* * * * *